US006146520A

United States Patent [19]

Gupte et al.

[11] Patent Number: 6,146,520

[45] **Date of Patent: *Nov. 14, 2000**

[54] SELECTIVE RE-EXTRACTION OF LUBE EXTRACTS TO REDUCE MUTAGENICITY INDEX

[75] Inventors: Anagha Avinash Gupte, Moorestown; David O. Marler, Deptford, both of N.J.

[73] Assignee: Mobil Oil Corporation, Fairfax, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/829,882

[22] Filed: Apr. 2, 1997

[51] Int. Cl.[7] ..... C10G 21/12

[52] U.S. Cl. ..... 208/322; 208/314; 208/311; 208/323; 208/326; 208/327; 208/330; 208/335; 585/836; 585/833

[58] Field of Search ..... 208/314, 311, 208/322, 323, 326, 327, 330, 335; 585/836, 833

[56] References Cited

U.S. PATENT DOCUMENTS

| | | | |
|---|---|---|---|
| Re. 27,494 | 9/1972 | Anderson et al. | 260/674 |
| 2,043,388 | 6/1936 | Merrill | 208/314 |
| 2,092,739 | 9/1937 | Van Dijck | 208/314 |
| 2,216,933 | 10/1940 | Atkins, Jr. | 208/314 |
| 2,220,016 | 10/1940 | Lyons | 208/312 |
| 2,886,523 | 5/1959 | Claridge et al. | 208/312 |
| 3,092,571 | 6/1963 | Francis | 208/324 |
| 3,755,154 | 8/1973 | Akabayashi et al. | 208/314 |
| 3,761,402 | 9/1973 | Atwood | 208/314 |
| 3,968,023 | 7/1976 | Yan | 208/86 |
| 4,499,187 | 2/1985 | Blackburn et al. | 435/34 |
| 4,636,299 | 1/1987 | Unmuth et al. | 208/87 |
| 5,034,119 | 7/1991 | Blackburn et al. | 208/309 |
| 5,039,399 | 8/1991 | Sequeira, Jr. | 208/311 |
| 5,308,470 | 5/1994 | Blackburn et al. | 208/14 |
| 5,488,193 | 1/1996 | Mackerer et al. | 585/455 |
| 5,616,238 | 4/1997 | Boyle et al. | 208/314 |

FOREIGN PATENT DOCUMENTS 0 417 980 A1 3/1991 European Pat. Off. .

*Primary Examiner*—Walter D. Griffin
*Assistant Examiner*—Nadine Preisch

[57] ABSTRACT

A process for reducing the Mutagenicity Index and/or the PCA content of a lubricating oil extract by re-extracting a lubricating oil extract with a second extraction solvent, different from the first extraction solvent, to form a secondary raffinate and a secondary extract mix; separating the secondary raffinate from the secondary extract mix; and separating the secondary raffinate and the secondary extract from said second extraction solvent.

4 Claims, 3 Drawing Sheets

SELECTIVE RE-EXTRACTION OF LUBE EXTRACTS TO REDUCE MUTAGENICITY INDEX

FIELD OF THE INVENTION

Mutagenicity of a lubricating oil extract, useful in ink oil and process oil for tire manufacture, obtained by solvent extraction of vacuum distillates or vacuum resids, is reduced by selectively re-extracting the lubricating oil extract to remove 3–7 ring polynuclear aromatics.

BACKGROUND OF THE INVENTION

Solvent extraction of lube distillates and de-asphalted oils with furfural or N-methyl pyrrolidone (NMP) is utilized to remove the 2+ ring aromatics and heteroatoms, resulting in improved thermal and oxidation stability of lubricant basestocks. The aromatic-rich lube extract "by products" from the solvent extraction process, such as furfural extracts, derived from vacuum distillates or vacuum resids possess unique solvency properties that make them ideal as process oils for rubber and ink oil manufacture.

While bright stock or residual aromatic extracts derived from vacuum residuals are typically non-carcinogenic, solvent extracts derived from neutral distillates are among the more carcinogenic products produced in the refining of petroleum.

Recently, there has been growing concern over public and worker exposure to the polynuclear aromatics (PNA's) from distillate aromatic extracts (DAE's) used in the tire industry. Untreated lube extracts derived from vacuum distillates have been demonstrated to produce a number of tumors in mouse skin painting bioassays, and as such they are labeled "May Cause Cancer" in the European Union.

The mutagenicity of lube extracts is believed to be a function of the 3–7 ring polynuclear aromatic content in the extract. Due to concerns for worker exposure to these carcinogenic extracts, public exposure to road-side tire dust and used tires, the European tire industry is interested in converting from using the currently available toxic DAE's to non-toxic DAE's.

Since petroleum refiners that market these products must provide labels outlining potential risks associated with the use of these products, there is a significant incentive to upgrade DAE's to make them non-carcinogenic.

The EU utilizes the polycyclic aromatic (PCA) content of DAE's as an indication of their toxicity, as measured by a gravimetric test, IP346. For treated DAE's the EU requires the PCA content of the product as measured by IP346 to be below 3 weight % for non-toxic labeling.

The mutagenicity of petroleum distillates may also be measured on a Mutagenicity Index (M.I.) scale via an ASTM-approved procedure called the Modified Ames Assay, as described in "Predicting Carcinogenicity of Petroleum Distillation Fractions using a Modified Salmonella Mutagenicity Assay", by G. R. Blackburn, *Cell Biology and Toxicology,* 2, pp. 63–84, 1986 and U.S. Pat. No. 4,499,187, the entire contents of which are hereby incorporated by reference. Current policy in the U.S. is that the measured M.I. must be less than 1 for non-toxic labeling.

As will be evident from the following examples, a PCA content of 3 wt %, according to IP346, does not necessarily equate to a M.I. of 1. It should be noted that the EU requirement is a regulatory one, while the M.I. is based on an empirical evaluation of mutagenicity of samples.

Conventional vacuum stripping of DAE's has been demonstrated to be ineffective in reducing PCA content below 3 wt %, since the boiling points of many of the PCA's fall within the same range as that of the desireable components of the process oils to be produced. Likewise, oxidation of PCA's to reduce toxicity has been shown to be of limited effect. While some reduction in M.I. can be obtained by oxidation, the reduction is insufficient to bring the products within the non-toxic range.

One method of treating process oils to reduce the PCA content is described in EP 0 417 980 A1, wherein process oils with an aromatic content of more than 50 wt % and a PCA content of less than 3 wt % are prepared from a primary extract of a lubricating oil distillate by re-extracting with a polar solvent in a counter-current extraction column, such that the volume ratio of the primary extract to the polar solvent is in the range of from 1:1 to 1:1.8. Notably, the polar solvent used for the re-extraction is the same solvent utilized in the initial extraction step.

Disadvantageously, according to EP 0 417 980 A1, the temperature in the head region of the extraction column must be at least 10° C. higher than the temperature at the bottom of the column, requiring careful monitoring and control of column temperature differentials.

Therefore, it would be desirable to develop a method of treating lubricating oil extracts to reduce the PCA content below 3 wt %, without expensive equipment for temperature monitoring and control of a counter-current extraction column.

SUMMARY OF THE INVENTION

A first object of the present invention is reducing the mutagenicity of a lubricating oil extract, useful in ink oil and process oil for tire manufacture, obtained by solvent extraction of vacuum distillates or vacuum resids, by selectively re-extracting the lubricating oil extract to remove 3–7 ring polynuclear aromatics.

A second object of the present invention is reducing the mutagenicity of a lubricating oil extract by selectively re-extracting the extract to remove 3–7 ring polynuclear aromatics in a counter-current extraction column, without expensive temperature monitoring and control equipment.

A third object of the present invention is reducing the mutagenicity of a lubricating oil extract from a solvent extractor by a low cost addition to an existing unit.

One embodiment of the present invention is directed to a process of reducing the Mutagenicity Index of a lubricating oil extract by re-extracting a lubricating oil extract with a second extraction solvent, different from the first extraction solvent, to form a secondary raffinate and a secondary extract mix; separating the secondary raffinate from the secondary extract mix; and separating the secondary raffinate and the secondary extract from said second extraction solvent.

In another embodiment, the present invention is directed to a process for reducing the PCA content of a lubricating oil extract by re-extracting a lubricating oil extract with a second extraction solvent, different from the first extraction solvent, to form a secondary raffinate and a secondary extract mix; separating the secondary raffinate from the secondary extract mix; and separating the secondary raffinate and the secondary extract from the second extraction solvent.

In another embodiment, the present invention is directed to a process for reducing the PCA content of a lubricating oil extract by mixing an anti-solvent with a lubricating oil extract mix from a solvent extractor to reduce the solvent capacity of the extraction solvent and increase its selectivity for PCA's, and cooling the mixture to facilitate phase separation of non-toxic components from the toxic PCA's.

BRIEF DESCRIPTION OF THE DRAWINGS

The above and other objects, features and advantages of the present invention will be better understood from the following detailed descriptions, taken in conjunction with the accompanying drawings, all of which are given by illustration only, and are not limitative of the present invention.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

According to the first and second embodiments of the present invention, a process is disclosed for reducing the Mutagenicity Index and/or the PCA content of a lubricating oil extract by re-extracting a lubricating oil extract with a second extraction solvent, different from the first extraction solvent, to form a secondary raffinate and a secondary extract mix; separating the secondary raffinate from the secondary extract mix; and separating the secondary raffinate and the secondary extract from said second extraction solvent.

Figure 1:
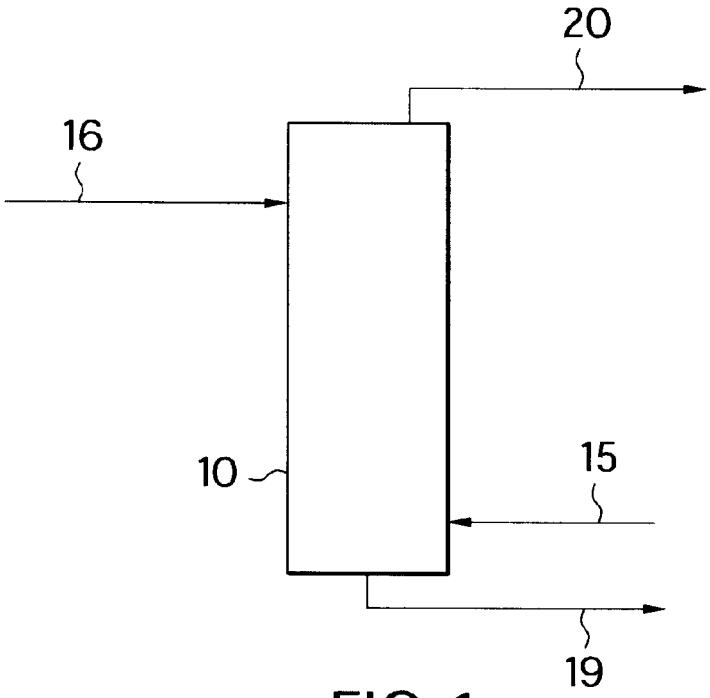
FIG. 1 is a schematic illustration of an apparatus for practicing the first and second embodiments of the present invention, wherein a counter-current extractor is provided with a secondary extraction solvent.

FIG. 1 illustrates an apparatus for practicing the invention of the first and second embodiments of the invention, wherein a counter-current extraction column 10 is fed with a stream of a primary extract mix 15 recovered from a conventional solvent extractor, said primary extract mix being composed of a first extraction solvent and a PCA-rich lubricating oil extract. A stream of a second extraction solvent 16, different from the first extraction solvent and having a higher dielectric constant than the first extraction solvent, enters the counter-current extraction column 10, and selective re-extraction takes place within the column. A secondary raffinate stream 20 is separated, which is composed of a PCA-depleted lubricating oil extract, which may be separated from the remaining extraction solvents by conventional techniques, such as distillation or flash-off, and utilized as the desired products discussed above; a non-toxic ink oil or a processing oil for rubber manufacture.

The PCA's which are removed by the selective re-extraction process exit the counter-current extraction column 10 in stream 19, along with a major amount of the secondary extraction solvent, which may be removed by conventional techniques, such as distillation or flash-off, and the secondary extraction solvent thus recovered may be recycled into the system.

Typically, the primary extraction solvent is one used in conventional solvent extraction techniques, such as phenol, N-methylpyrrolidone (NMP) or furfural.

The secondary extraction solvent is selected to be different from the first extraction solvent, and is selected to have a higher dielectric constant ($\epsilon$) than that of the primary extraction solvent. Suitable examples of a secondary extraction solvent within the scope of the present invention include, but are not limited to dimethylsulfoxide (DMSO), sulfolane and propylene carbonate. The dielectric constant of the secondary extraction solvent may range from about 20 to 80, depending on the dielectric constant of the primary extraction solvent.

Additionally, the secondary extraction solvent may be a mixed solvent, so long as the dielectric constant of the mixture is greater than the dielectric constant of the first extraction solvent. Such mixed solvents include, but are not limited to NMP/water, furfural/water, NMP/ethylene glycol, furfural/ethylene glycol and DMSO/cyclohexane.

The dielectric constants of some representative solvents are as follows:

TABLE I

| solvent | $\epsilon$ @ temp ° C. |
|---|---|
| furfural | 46 @ 1° C. |
| " | 41 @ 20° C. |
| phenol | 9.8 @ 60° C. |
| propylene carbonate | 65.1 @ 25° C. |
| sulfolane | 44 @ 25° C. |
| ethylene glycol | 41.2 @ 25° C. |
| water | 77 @ 25° C. |
| triethylene glycol | 23.7 @ 23° C. |
| DMSO | 46.6 @ 25° C. |

The polarity of the solvent is related to the value of the dielectric constant; therefore, the higher the dielectric constant, the greater the polarity of the solvent. Additionally, as is evident from the $\epsilon$ values of furfural, the value of the dielectric constant is sensitive to changes in temperature. Generally, an inverse relationship exists between dielectric constant and temperature, such that as temperature decreases, the dielectric constant of a given solvent increases. Therefore, one manner of adjusting the dielectric constant of the secondary solvent according to the present invention is to cool the secondary solvent, thus raising its dielectric constant.

Figure 2:
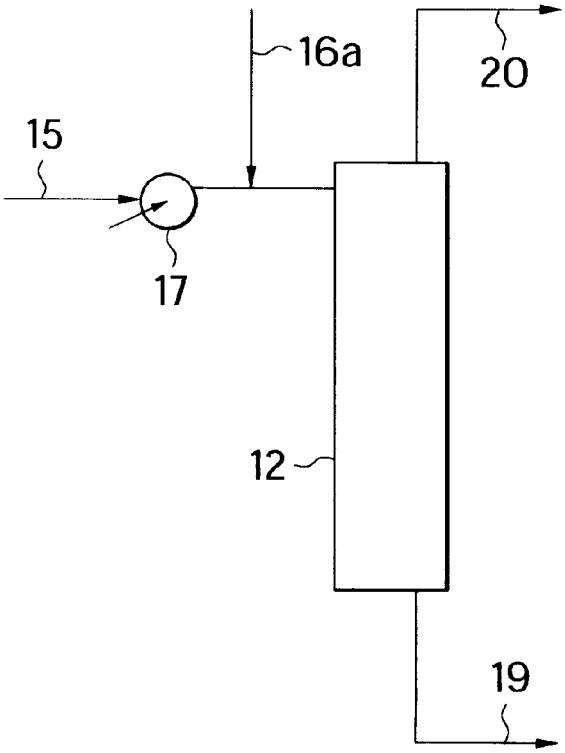
FIG. 2 is a schematic illustration of an apparatus for practicing the third embodiment of the present invention, wherein an anti-solvent stream is introduced into a stream of a primary solvent extract.

In a third embodiment of the present invention, illustrated in FIG. 2, an anti-solvent stream 16*a* is added to the lubricating oil extract mix 15 exiting the solvent extractor (not shown), which is cooled by a heat exchanger 17.

The thus mixed anti-solvent/lubricating oil extract streams enter the a settling vessel 12 wherein they are separated into a PCA-lean phase 20 and a PCA-rich phase 19, exiting the settling vessel.

According to the third embodiment, the anti-solvent is selected such that it decreases the solvent capacity of the primary extraction solvent, but increases its selectivity for PCA's. Suitable anti-solvents are necessarily limited by the nature of the primary solvent. For example, when furfural is used as the primary solvent, ethylene glycol is a good anti-solvent. Other suitable solvent/anti-solvent combinations are: NMP/water, furfural/propylene carbonate and furfural/sulfolane, for example.

As can be understood from FIG. 2, the materials necessary to effect the third embodiment may be easily added to existing solvent extraction systems, at relatively low cost.

According to the process of the present invention, the solvent treat, i.e. the volume ratio of secondary extraction solvent:lubricating oil extract, may range from 0.2 to 2, more preferably from 0.3 to 1. Advantageously, the solvent treat may be reduced substantially by lowering the temperature of the secondary extraction solvent, which provides not only a benefit in using less solvent, but also generally increases the yield of final product.

The temperature range for the selective re-extraction of the present invention may range from about 0° C. to 100° C., preferably from about 20° C. to 65° C.

When utilizing a mixed solvent as the secondary extraction solvent, the ratio of the solvents may range between 99:1 and 1:99, with the relative concentrations being selected according to the dielectric constant of the mixed solvents.

According to the third embodiment of the present invention, the ratio of anti-solvent to primary extraction solvent may range from 1:99 to 99:1, with the relative concentrations being selected according to the dielectric constant of the solvent/antisolvent mixture.

EXAMPLES

Batch extractions were conducted on two different DAE's: a 700 S.U.S. (700") furfural extract and a 450 S.U.S. (450") furfural extract. The extractions were conducted at differing solvent treats and temperatures and were performed in a 1 L jacketed glass extraction apparatus. Some samples were successively extracted with fresh solvent in order to simulate cross-current, multistage operation.

The relevant chemical and physical parameters of the two DAE's were measured prior to re-extraction in order to provide an appropriate baseline for evaluation of the inventive process. The initial parameters of the DAE's are presented in Table II, below.

TABLE II

| | 700" Extract | 450" Extract |
|---|---|---|
| API | 8.45 | 10.6 |
| Pour Pt, F | 53.2 | — |
| Sulfur, wt % | 4.8 | 4.2 |
| Nitrogen, ppm | 2300 | 1800 |
| Basic N, ppm | — | 467 |
| kv 40 C, cS | 1983 | — |
| kv 100 C, cS | 36.76 | 24.16 |
| IBP | 685.6 | 651.2 |
| 5% | 797.5 | 766.6 |
| 10% | 843 | 795 |
| 30% | 910 | 857.3 |
| 50% | 944 | 897.3 |
| 90% | 1016 | 990.7 |
| EP | 1097 | 1094.6 |
| wt % Aromatics | 89.3 | 81.9 |
| Mono-aromatics | 14.3 | 13.0 |
| Di-aromatics | 14.3 | 7.9 |
| Tri-aromatics | 10.0 | 8.9 |

TABLE II-continued

| | 700" Extract | 450" Extract |
|---|---|---|
| Tetraaromatics | 5.1 | 5.6 |
| Pentaromatics | 12.3 | 11.0 |
| Aromatic Sulfur Compounds | 11.7 | 6.7 |
| Unidentified Aromatics | 21.6 | 28.7 |
| Mutagenicity Index | 3.3 | 2.9 |
| PCA by IP346, wt % | 17.4% | 17.3% |

Comparative Example A

Figure 3:
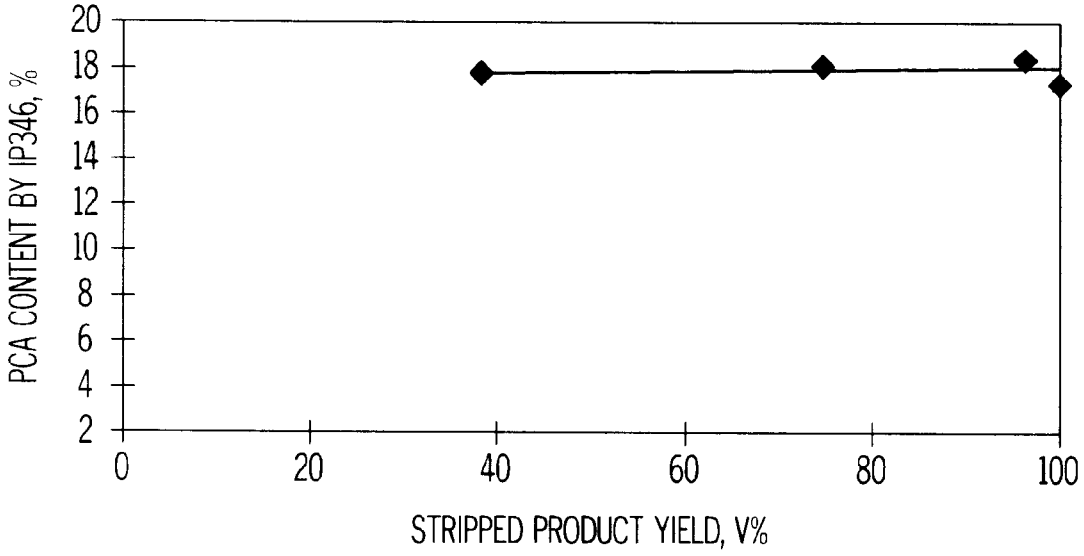
FIG. 3 PRIOR ART
FIG. 3 is a graph which illustrates the effectiveness of conventional vacuum stripping in removing PCA's from DAE.
Figure 4:
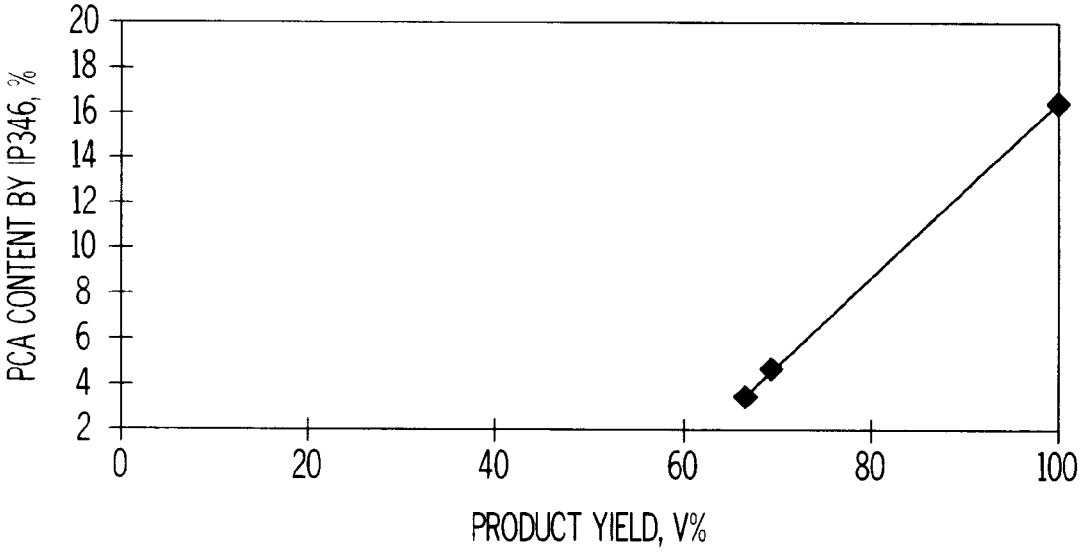
FIG. 4 is a graph which illustrates the effectiveness of selective re-extraction according to the present invention, in removing PCA's from DAE.

In order to demonstrate the significance of the present inventive process over the conventional technique of vacuum stripping, the 450" extract was subjected to vacuum stripping, and various cuts of product were obtained by stripping off the front end and PCA contents were measured by IP346. FIG. 3 is a graph which illustrates that no statistically significant decrease in PCA content is obtained by vacuum stripping. Even at yields of only 39 vol % of stripped product, the PCA content is 17.1%, compared to 17.3% in the untreated DAE, which is within the statistical error of the test. This test indicates that the toxic PCA's are distributed throughout the boiling point range of the 450" extract.

In some of the following examples, an alternative analytical predictor for M.I. was used in order to more rapidly evaluate the M.I. of the various secondary raffinates. The alternative analytical method measures the relative concentrations of PCA's, and is applicable to crude oil, distillates, extracts, raffinates and basestocks.

Figure 6:
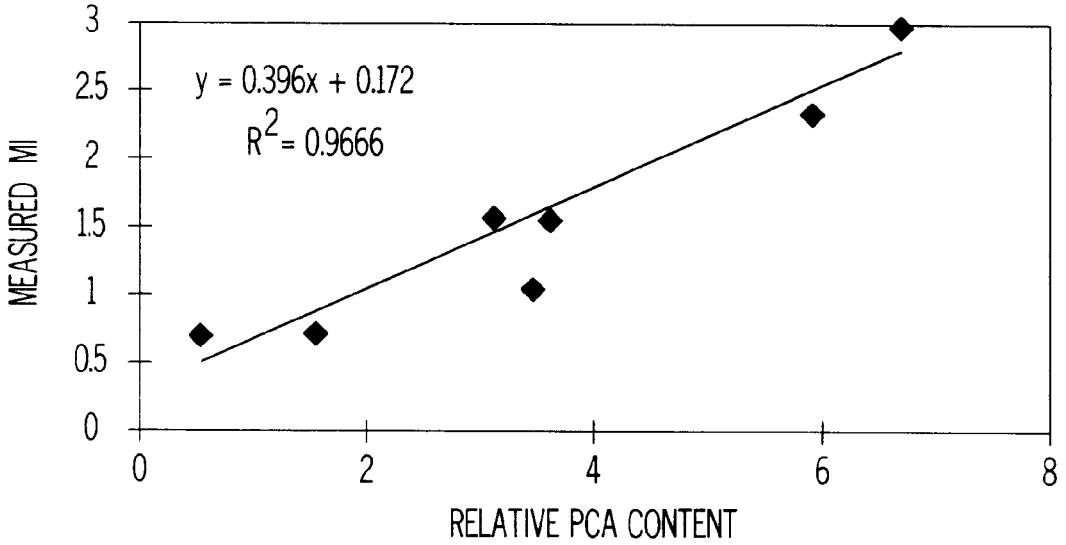
FIG. 6 is a graph demonstrating the correlation between measured M.I. and the relative PCA content of various DAE's.

FIG. 6 is a graph demonstrating the correlation between measured M.I. and the relative PCA contents of various extracts. The correlation between measured M.I. and relative PCA content was 0.967. The predicted M.I.'s disclosed herein were obtained using the regression equation in FIG. 6.

Example 1

200 mL of the 700" extract was mixed with 400 mL of DMSO solvent (200% treat ratio) in a 1 L glass extraction apparatus. The mixture was heated to 250° F. (121° C.), vigorously stirred at 1000 rpm for 25 minutes and allowed to separate into two phases. The lighter raffinate was stripped with nitrogen under vacuum to remove the DMSO, resulting in a PCA-lean secondary raffinate which was 81 vol % (80 wt %) of the original extract. The heavier PCA-rich secondary extract phase was also vacuum stripped of solvent, resulting in a PCA-rich extract which measured 20% of the original extract volume. The M.I. of the secondary raffinate was determined by the Modified Ames Assay test to be 1.5.

Example 2

200 mL of the 700" extract was mixed with 400 mL of DMSO in a 1 L glass extraction apparatus. The mixture was heated to 150° F. (66° C.) and vigorously stirred at 1000 rpm for 15 minutes and then allowed to separate into two phases. The lighter secondary raffinate was stripped with nitrogen under vacuum to remove the DMSO, resulting in a PCA-lean secondary raffinate which was 88 vol % (87 wt %) of the original extract volume. The M.I. of the secondary raffinate was measured as 1.5, which represents a 50% reduction in M.I. with only a 12% yield loss by volume.

Accordingly, it is clear from Examples 1 and 2 that the re-extraction temperature may be optimized to increase yield, without detriment to the reduction in toxicity of the secondary raffinate.

Example 3

A sample was prepared and treated as in Examples 1 and 2, except that the temperature and treat ratio were varied, in order to determine whether better yields could be obtained, without detriment to the M.I. In Example 3, the M.I. was predicted by the relative PCA content.

Experimental parameters and results for Examples 1–3 are summarized in Table III, below.

TABLE III

| | | | Yield | | | |
|---|---|---|---|---|---|---|
| Ex. no. | Temp. | Treat | (vol %) | (wt %) | Pred.[1] M.I. | Meas[2] M.I. |
| 1 | 250° F. | 200% | 81 | 80 | 1.4 | 1.5 |
| 2 | 150° F. | 200% | 88 | 87 | 1.6 | 1.5 |
| 3 | 100° F. | 300% | 88.3 | 87.1 | 1.1 | — |

[1]Predicted M.I. from relative PCA content
[2]Measured M.I. from Modified Ames Test

Examples 4–7

Examples 4–7 were prepared similarly to Examples 1–3, except that the 450" extract was used as the untreated extract. A mixture of 300% DMSO/100% cyclohexane (treat relative to the sample volume) was used as the secondary extraction solvent, and multiple extractions were performed. The number of extraction stages and the extraction temperatures were varied as indicated in Table IV, below.

TABLE IV

| Ex. | | | Yield | | Pred. | Meas. | |
|---|---|---|---|---|---|---|---|
| No. | stages | Temp. | (vol %) | (wt %) | M.I. | M.I. | PCA %[3] |
| 4 | 4 | 75° F. | 83.5 | 80.1 | 0.75 | 0.8 | 6.3 |
| 5 | 7 | 75° F. | 77 | 73 | 0.48 | 0.3 | 3.0 |
| 6 | 5 | 120° F. | 66.2 | 63.5 | 0.36 | — | 2.5 |
| 7 | 4 | 150° F. | 67.2 | 65 | 0.46 | — | 2.9 |

[3]PCA measured according to IP346

Figure 5:
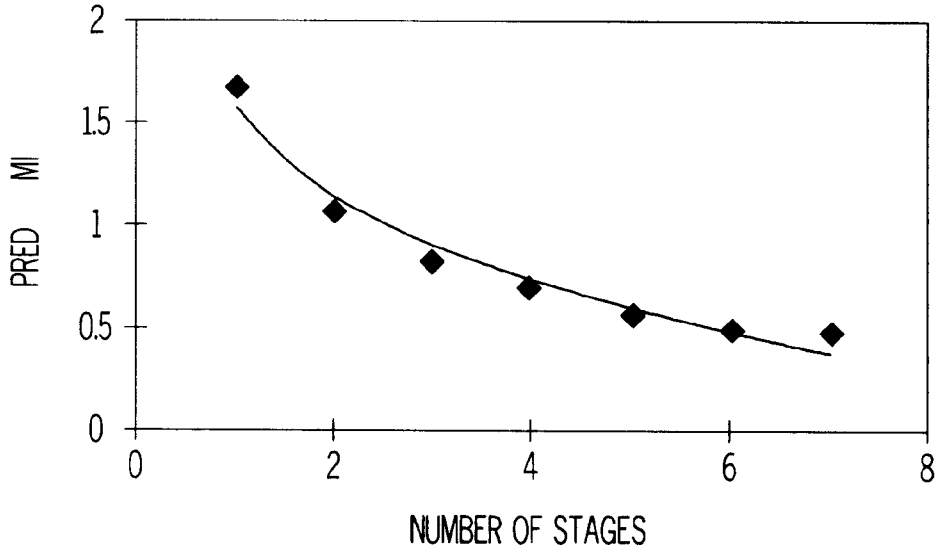
FIG. 5 is a graph which illustrates the effect of multiple re-extractions on Mutagenicity Index of the extract phase.

These data demonstrate that product yield may be increased by utilizing more extraction stages at a lower temperature, without an increase in toxicity, as measured by the PCA content. FIG. 5 is a plot of the predicted M.I. as a function of the number of stages for 300% DMSO/100% cyclohexane extraction of the 450" extract, as in Example 5. Each extraction stage employed fresh solvent, so as to simulate a multistage cross-current extraction procedure. The plot in FIG. 5 demonstrates that the degree of detoxification is sensitive to the number of extraction stages. Moreover, in this case the measured PCA content of the product from the 7-stage extraction met the below 3 wt % limit for non-toxic treated extracts in Europe, as well as the M.I. (0.3) met the less than 1 standard currently utilized in the U S., at a product yield of 77 vol % (73 wt %).

Examples 8 and 9

Treatment of Examples 8 and 9, using the 700" extract, is summarized in Table V, below.

TABLE V

Extraction of 700" Extract with DMSO and DMSO/Cyclohexane

| Ex. No. | Solvent | Treat | Temp | Yield | Pred MI | Measd. MI | PCA %[4] |
|---|---|---|---|---|---|---|---|
| 8 | DMSO | 300% | 75° F. | 73% | 0.6 | 0.61 | 5.7 |
| 9 | DMSO/C-H | 300/100% | 75° F. | 88% | 0.76 | 0.3 | 6.2 |

[4]By IP346

These data indicate that the use of cyclohexane in conjunction with DMSO improves the selectivity of the solvent for PCA's and results in higher product yields at approximately the same degree of detoxification.

Examples 10 and 11

In Examples 10 and 11, an anti-solvent, ethylene glycol, was mixed with furfural at a ratio of 70/30 (vol/vol) furfural/ethylene glycol and used as the re-extraction solvent. Example 10 utilized the 450" extract, while Example 11 utilized the 700" extract. Results are summarized in Table VI, below.

TABLE VI

| | | | Yield | | | |
|---|---|---|---|---|---|---|
| Ex. No. | Treat | Temp | (vol %) | (wt %) | M.I. | PCA % |
| 10 | 100% | 100° F. | 42 | 39.6 | — | 2.9 |
| 11 | 100% | 100° F. | 75 | 73.5 | 0.7 | — |

These data indicate that addition of an anti-solvent to an existing lubricating oil extract, composed of a DAE and a conventional extraction solvent, is effective to reduce either or both of the M.I. or the PCA content of the DAE.

Comparative Examples

The following Comparative Examples are taken from the text of EP 0 417 980 A1, Table 2, examples 1–3, the entire content of which is hereby incorporated by reference.

TABLE VII

| Comparative Ex. No. | Primary Extract: Furfural ratio | Mesoraffinate Yield (wt %) | PCA (wt %) |
|---|---|---|---|
| B | 1:1.5 | 51 | 2.1 |
| C | 1:1.5 | 34 | 1.9 |
| D | 1:1.5 | 31 | 1.2 |

As can be seen from the comparative data, each of Comparative Examples B, C and D have drastically reduced secondary raffinate (mesoraffinate) yields, as compared to the secondary raffinate yields of the present invention.

Importantly, it has been determined that the physical properties of the DAE's re-extracted according to the presently disclosed process are not drastically altered, having viscosities and aniline points suitable for use in the intended products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A selective extraction process for producing a high yield of aromatics-rich process oil extract having a low Mutagenicity Index and low concentration of polycyclic aromatics (PCA) from a feedstock comprising the distillate aromatic extract (DAE) recovered from the first extraction solvent of a lubricating oil solvent refining process, said extraction process comprising:

contacting the DAE with a second extraction solvent in a second extraction zone at a temperature from 0° C. to 100° C. for a time sufficient to selectively extract the polycyclic aromatics from the DAE and form a two phase extraction mixture, in which the second solvent comprises dimethylsulfoxide, sulfolane and propylene carbonate and has a higher dielectric constant of at least 44 at 25° C. compared to the first extraction solvent;

separating the second extraction zone extraction mixture and recovering a raffinate comprising the aromatics-rich process oil in at least a 70 weight percent yield, in which the aromatics-rich process oil contains not more than 3.0 weight percent PCA and exhibits a Mutagenicity Index of not more than 1.0.

2. The process of claim 1 in which the selective extraction process is a batch process or continuous counter-current extraction process.

3. The process of claim 1 in which the temperature is from 20° C. to 65° C.

4. The process of claim 1 in which the second extraction solvent is a mixture of solvents.

* * * * *